US012193566B1

(12) United States Patent
Wilder et al.

(10) Patent No.: US 12,193,566 B1
(45) Date of Patent: Jan. 14, 2025

(54) ROTATING ORGANIZER

(71) Applicant: Cynosure Holdings, LLC, Frisco, TX (US)

(72) Inventors: Bruce Gary Wilder, Frisco, TX (US); Mitchell Henry Harrison Kadel, Granite Falls, NC (US)

(73) Assignee: Cynosure Holdings, LLC, Frisco, TX (US)

( * ) Notice: Subject to any disclaimer, the term of this patent is extended or adjusted under 35 U.S.C. 154(b) by 0 days.

(21) Appl. No.: 18/755,566

(22) Filed: Jun. 26, 2024

(51) Int. Cl.
*A47B 49/00* (2006.01)

(52) U.S. Cl.
CPC ..... *A47B 49/002* (2013.01); *A47B 49/008* (2013.01)

(58) Field of Classification Search
CPC ..... A47B 49/002; A47B 49/008; A47F 5/03; A47F 3/085
USPC ..... 211/164
See application file for complete search history.

(56) References Cited

U.S. PATENT DOCUMENTS 112,022 A * 2/1871 Ells ..... A47F 5/03 34/187
125,928 A * 4/1872 Blake ..... A47F 5/02 40/497
141,064 A * 7/1873 McMahon ..... A47F 5/03 211/164
253,290 A * 2/1882 Hunter ..... A47F 5/03 211/164
412,131 A * 10/1889 Smith ..... A47B 49/002 34/188
570,322 A * 10/1896 Mansfeld ..... A47F 3/10 211/164
828,926 A * 8/1906 Clare ..... A47B 49/002 211/164
919,725 A * 4/1909 Huffman ..... A47B 49/002 211/164
937,366 A * 10/1909 Friedman ..... A47F 5/02 211/164

(Continued)

FOREIGN PATENT DOCUMENTS

DE 830892 C * 2/1952
DE 19512210 C1 * 5/1996 ..... A47B 49/002

(Continued)

OTHER PUBLICATIONS

PLAID; "Plaid Rotational Organizer Storage Container That Stores 24 Standard 2 fl oz Bottles of Acrylic Paint for DIY Arts and Crafts, 31100, Black"; Oct. 7, 2021; https://www.amazon.com/Plaid-Rotational-Organizer-Container-31100/dp/B09JB1DF1C/ref=sr_1_2?crid=31TFX2RVXSLL3&keywords=plaid+rotational+organizer&qid=1693493117&sprefix=plaid+rotational+organizer%2Caps%2C113&sr=8-2; 8 pages.

*Primary Examiner* — Stanton L Krycinski
(74) *Attorney, Agent, or Firm* — Conley Rose, P.C.; Grant Rodolph; Robert E. Kent

(57) ABSTRACT

In some examples, a rotational organizer includes first and second support frames, first and second side supports configured to couple to the first and second support frames via a tab and slot arrangement to span the first and second support frames, first and second end caps, and an axle configured to pass through a center point of the first and second end caps to pivotally couple at a first end to the first support frame and at a second end to the second support frame, wherein the axle couples to the first and second end caps via a snap-fit, and wherein the axle comprises a lattice reinforcement structure.

19 Claims, 10 Drawing Sheets

(56) References Cited

U.S. PATENT DOCUMENTS 949,393 A * 2/1910 Crego ..... A47F 5/03 211/164
1,001,447 A * 8/1911 Riley ..... A47B 11/00 211/164
1,281,105 A * 10/1918 Unger ..... A47F 5/03 211/144
1,487,540 A * 3/1924 Holloway ..... A47F 5/03 211/164
1,552,290 A * 9/1925 Fowler ..... A47F 5/03 211/164
1,695,618 A * 12/1928 Thompson ..... A47F 5/03 211/164
1,830,373 A * 11/1931 Schmidt ..... B60P 3/055 211/164
1,830,828 A * 11/1931 Eaton ..... A47F 5/03 211/164
1,867,145 A * 7/1932 Godfrey ..... A47B 63/065 211/164
2,646,891 A * 7/1953 Morgan ..... B25H 3/025 312/902
3,038,773 A * 6/1962 Vasbinder, Sr. ..... A47K 1/09 211/164
3,404,784 A * 10/1968 Scholfield ..... A47B 63/065 211/164
3,674,155 A * 7/1972 Kessler ..... B25H 3/00 211/164
3,732,829 A * 5/1973 Bech ..... A47B 49/002 211/144
3,784,024 A * 1/1974 Kristy ..... A47B 49/002 211/164
4,852,748 A * 8/1989 Burgess ..... B25H 3/04 211/164
4,932,536 A * 6/1990 Schlunke ..... B65G 1/127 211/164
5,039,180 A * 8/1991 Lemons ..... A47B 81/068 312/267
5,040,689 A * 8/1991 Hull ..... A47B 49/008 211/121
5,186,529 A * 2/1993 Smith ..... A47B 49/002 312/249.7
5,248,049 A * 9/1993 Murphy, Sr. ..... B25H 3/06 211/164
5,531,332 A * 7/1996 Monnens ..... H01H 9/025 211/DIG. 1
6,557,491 B1 * 5/2003 Weiser ..... A01K 39/014 119/57.8
D488,643 S * 4/2004 Birmingham ..... D6/682.2
D494,775 S * 8/2004 Birmingham ..... D6/682.2
7,878,341 B2 * 2/2011 Ming ..... B25H 3/025 211/164
8,950,599 B2 * 2/2015 Wilder ..... B25H 3/06 211/77
8,955,699 B2 * 2/2015 Wilder ..... A47B 49/002 211/77
9,095,210 B1 * 8/2015 Alspaugh ..... A23L 3/0155
10,849,441 B1 * 12/2020 Rapue ..... A47F 5/0087
10,927,998 B1 * 2/2021 Crockett ..... A47B 3/10
11,412,666 B2 * 8/2022 Choi ..... A01G 31/047
2005/0194336 A1 * 9/2005 Wu ..... A47B 49/002 211/164
2011/0220600 A1 * 9/2011 Wilder ..... A47B 49/00 211/163

FOREIGN PATENT DOCUMENTS

DE 19604847 A1 * 8/1997 ..... A47B 49/002
DE 29710466 U1 * 8/1997 ..... A47B 49/002
FR 2467576 A2 * 4/1981

* cited by examiner

ROTATING ORGANIZER

BACKGROUND

An organizer enables a user to more efficiently organize and/or store various items. Sometimes, the organizer increases a usable volume of space for such organizing or storage. For example, an organizer that makes use of vertical space, in addition to horizontal space, may increase the usable volume of space for such organizing or storage. To increase an ability of the user to access various portion of the organizer, the organizer may rotate or otherwise move exposing different portions of the organizer to a reach of the user based on a position of the organizer at that point in time.

However, different users may have varying organizational needs, as well as available space for an organizer, such that a one-size-fits-all approach may be less useful than a configurable approach. To provide an increased amount of implementation flexibility and usefulness of an organizer, the organizer may be modular. For example, components of a support structure or frame of the organizer may be interchangeable among other compatible components to enable the construction of a full organizer. This interchangeability may enable tailoring of the organizer to particular application environments, such as by altering a volume of space required for the organizer to be present, a mounting style or orientation of the organizer, accessories that may be integrated with the organizer, or the like.

SUMMARY

In some examples, a rotational organizer includes first and second support frames, first and second side supports configured to couple to the first and second support frames via a tab and slot arrangement to span the first and second support frames, first and second end caps, and an axle configured to pass through a center point of the first and second end caps to pivotally couple at a first end to the first support frame and at a second end to the second support frame, wherein the axle couples to the first and second end caps via a snap-fit, and wherein the axle comprises a lattice reinforcement structure.

In some examples, a rotational organizer includes an axle, a plurality of slats parallel to the axle, wherein each of the slats has a center of gravity located to cause bottom surfaces of each of the slats to be perpendicular to a gravitational force acting in a downward direction on the slats, two end caps perpendicular to the axle, wherein the slats are retained between the end pieces by pivotal couplings via which the slats and end pieces can rotate around the axle, and two support frames, wherein the axle passes through the two end caps to pivotally couple to the two support frames, wherein the two end caps are retained within the two support frames, wherein the axle comprises a lattice reinforcement structure.

DETAILED DESCRIPTION

Figure 1:
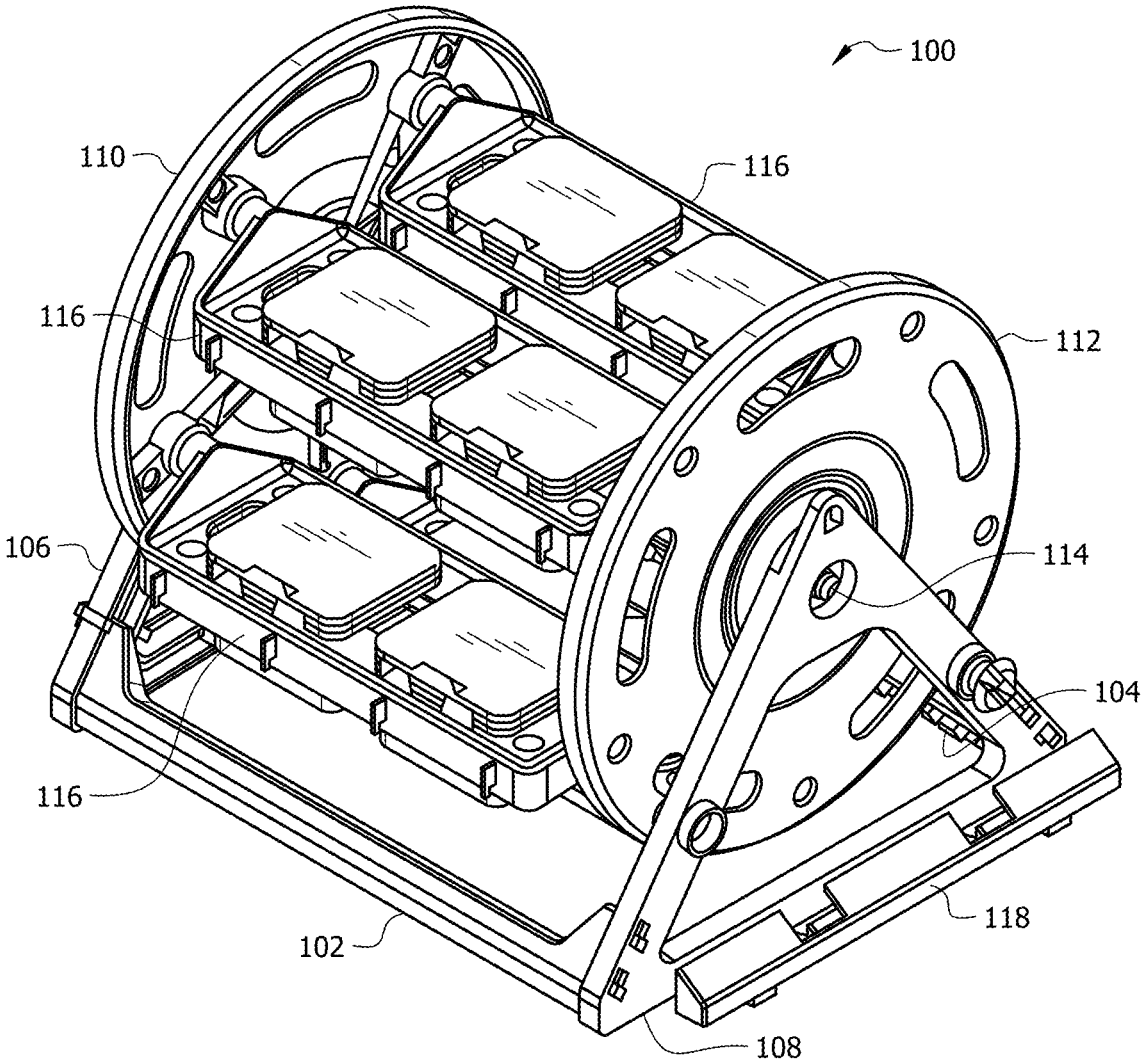
FIG. 1 is an illustration of a rotational organizer, in accordance with various examples.

FIG. 1 is an illustration of a rotational organizer 100, in accordance with various examples. The rotational organizer 100 may be modular, enabling components of the rotational organizer 100 to be interchangeable to tailor the rotational organizer for a particular application environment. In an example, the rotational organizer 100 includes support frames 102, 104, side supports 106, 108, end caps 110, 112, center axle 114, and slats 116. In some examples, the support frames 102, 104 may have an A-frame design, while in other examples the support frames 102, 104 may have any suitable shape. The support frames 102, 104, side supports 106, 108, end caps 110, 112, center axle 114, and slats 116 may be interchangeable to customize the rotational organizer 100 to particular application environments. For example, the support frames 102, 104 may be coupled to side supports 106, 108 having a first length to form a rotational organizer having a first footprint size. Similarly, the support frames 102, 104 may be coupled to side supports 106, 108 having a second length to form a rotational organizer having a second footprint size that is larger or smaller than the first footprint size.

In another examples, a center axle 114 having a first structure may be suitable for implementation in a first application environment or configuration of the rotational organizer 100 and a center axle 114 having a second structure may be suitable for implementation in a second application environment or configuration of the rotational organizer 100. For example, as a length of the center axle 114 increases, torque placed on the center axle 114 through rotational movement of the rotational organizer 100 may also increase. If certain circumstances, the torque may become greater than tolerable by the center axle 114, such as based on a material of the center axle 114, construction geometry of the center axle 114, or the like. Responsive to the torque on the center axle 114 exceeding the amount tolerable by the center axle 114, the center axle 114 may bend, break, become stressed, or otherwise fail. However, it may be desirable to increase a length of the center axle 114, such as to increase a usable storage space of the rotational organizer 100. By modifying a structure of the center axle 114, torsional deflection, or deformation when a twisting force is applied, of the center axle 114 may be reduced. For example, the center axle 114 as shown in FIG. 1 has a solid center core with a hexagonal structure protruding outward from the center core. In some examples, the hexagonal structure decreases torsional deflection of the center axle 114 in comparison to a center axle 114 that lacks the hexagonal structure. For example, in comparison to a center axle 114 that includes torsional and linear gussets but lacks the hexagonal (or another geometric shape) structure.

Generally, the support frames 102, 104 interface with the side supports 106, 108 as shown in FIG. 1 to form a base of the rotational organizer 100. The support frames 102, 104 may interface with the side supports 106, 108 in any suitable manner, the scope of which is not limited herein. For example, the support frames 102, 104 may interface with the side supports 106, 108 via one or more tabs (e.g., a tab and slot construction), via a friction fit (e.g., "press-fit"), via a snap-fit, via one or more fasteners (not shown) such as rivets, screws, nuts and bolts, welding, plastic welding, or the like. An interface type of the support frames 102, 104 with the side supports 106, 108 may be dependent on a material of components of the support frames 102, 104 and/or the side supports 106, 108, an intended application environment of the rotational organizer 100, a desired strength or load bearing capacity of the rotational organizer 100, or the like.

In an example, each of the end caps 110, 112 includes an aperture substantially centered on the respective end cap 110, 112 through which at least a portion of the center axle 114 may protrude. The center axle 114 may protrude through the apertures of each of the end caps 110, 112 to interface with the respective side supports 106, 108 as shown in FIG. 1 to complete a structure of the rotational organizer 100. The center axle may interface with the side supports 106, 108 in any suitable manner, the scope of which is not limited herein. For example, the center axle 114 may interface with the side supports 106, 108 via one or more tabs (e.g., a tab and slot construction), via a friction fit (e.g., "press-fit"), via a snap-fit, via one or more fasteners (not shown) such as rivets, screws, nuts and bolts, a split pin through a hole passing through the center axle 114, welding, plastic welding, or the like. An interface type of the center axle 114 with the side supports 106, 108 may be dependent on a material of components of the center axle 114 and/or the side supports 106, 108, an intended application environment of the rotational organizer 100, a desired strength or load bearing capacity of the rotational organizer 100, or the like.

Each of the end caps 110, 112 may further include multiple mounting points. The mounting points may take any suitable form, the scope of which is not limited herein. In some examples, the mounting points are apertures, such as holes or slots, in the respective end caps 110, 112. The mounting points of the end caps 110, 112 may interface with the slats 116 to mount the slats 116 in the rotational organizer. For example, the slats 116 may include protrusions on opposing ends of the slats 116. The protrusions may interface with the mounting points to mount, affix, or otherwise couple the slats 116 to the end caps 110, 112. For example, the slats 116 may interface with the end caps 110, 112 via one or more tabs (e.g., a tab and slot construction), via a friction fit (e.g., "press-fit"), via a snap-fit, via a slip or sliding fit, via one or more fasteners (not shown) such as rivets, screws, nuts and bolts, a split pin through a hole passing through the protrusions of the slats 116, welding, plastic welding, or the like. An interface type of the slats 116 with the end caps 110, 112 may be dependent on a material of components of the slats 116 and/or the end caps 110, 112, an intended application environment of the rotational organizer 100, a desired strength or load bearing capacity of the rotational organizer 100, or the like.

In an example, the slats 116 may be configurable to cause the slats 116 to be more suitable for implementation in a particular application environment than in the absence of such configuration. In this way, the slats 116 may be modular in nature, or may support modularity of the rotational organizer 100. For example, one or more of the slats 116, which may be considered shelves of the rotational organizer 100, may include features such as cutouts, apertures, raised portions, recessed portions, or the like. The features of the slats 116 may enable the slats 116 to be customized for holding particular tools or other items, containers, or the like. In some examples, one or more of the slats 116 may include or interface with slat trays (not shown). The slat trays may include features such as cutouts, apertures, raised portions, recessed portions, or the like. The features of the slat trays may enable the slats 116 to have a generic or standardized construction that is adapted via the slat trays to be customized (e.g., modular) for holding particular tools or other items, or the like. In some examples, the slats 116 and the slat trays include one or more mechanisms for affixing the slat trays to the slats 116, such as magnets, snap fits, latches, or the like.

The slats 116 may have a structure, shape, or general construction that aids in orienting the slats 116 while mounted in the rotational organizer 100. For example, the slats 116 may be weighted by any suitable material to cause a bottom surface of the slats 116 to remain substantially parallel to the ground while the slats 116 are mounted in the rotational organizer 100. At least some implementations of the slats 116 may be constructed of multiple materials. For example, a first portion of the slats 116 may be constructed of a first material and a second portion of the slats 116 may be constructed of a second material, where the second material has a density greater than the first material. The second material may be positioned lower than the first material in the slats 116 to cause the slats 116 to be weighted, as described above. In another example, the slats 116 may additionally, or alternatively, have a structure that causes the bottom surface of the slats 116 to remain substantially parallel to the ground while the slats 116 are mounted in the rotational organizer 100. For example, the slats 116 may have a structure in which a center of gravity of the slats 116 is lower than a centerline of rotation of the slats 116 about which the slats 116 rotate with respect to the end caps 110, 112. As a result, the slats 116 may be substantially self-leveling such that items placed therein remain in an upward facing orientation.

In some examples, the components of the rotational organizer 100 (e.g., the support frames 102, 104, side supports 106, 108, end caps 110, 112, center axle 114, and/or slats 116) may be assemblable to form the rotational organizer 100 without the aid of tools. In some examples, the components of the rotational organizer 100 may be assemblable to form the rotational organizer 100 without the aid of additional fasteners (e.g., screws, etc.). In other examples, the fastener-less construction of the rotational organizer 100 may be augmented with one or more fasteners, such as to provide increased strength or stability to the rotational organizer 100 for certain application environments. The components of the rotational organizer 100 may be formed of, or comprise, any suitable material. For example, the components of the rotational organizer 100 may be formed of any suitable plastic material, any suitable metal material, a resin, a synthetic material such as nylon, a composite material, natural materials such as wood, or the like. The components of the rotational organizer 100 may be formed according to any suitable process, such as three-dimensional (3D) printing, injection molding, machining (e.g., milling, carving, etc.), casting, stamping, or the like. The components of the rotational organizer 100 may be substantially solid in nature, hollow, or have support structures of any suitable size or pattern. In some examples, at least some of the components of the rotational organizer 100 vary in material and/or formation process than at least some other of the components of the rotational organizer 100. For example, at least some of the components of the rotational organizer 100 may be formed via any suitable process of a first material, such as a plastic, and at least some other of the components of the rotational organizer 100 may be formed by any other, or the same, suitable process of a second material, such as a different plastic, metal, a combination of metal and plastic, or the like.

In some examples, the rotational organizer 100 may be mountable or otherwise affixable to a surface, such as a ceiling, a wall, a tabletop or work top, or the like. In other examples, the rotational organizer 100 may be mountable to a trailer, vehicle, or the like. Mounting of the rotational organizer 100 may be horizontal, in which the center axle 114 is substantially parallel to the ground, vertical, in which the center axle 114 is substantially perpendicular to the ground, or at an angle such that the center axle 114 is neither parallel nor perpendicular to the ground. In some examples, to facilitate such mounting, the rotational organizer 100 may include mounting points. For example, each side support 106, 108 may include one or more mounting points such as holes to accommodate screws, nails, or other fasteners to attach the rotational organizer 100 to the surface, one or more tabs to facilitate interlocking the rotational organizer with a corresponding structure on the surface, or the like. In another example, to facilitate such mounting, the rotational organizer 100 may interface with mounting brackets 118. For example, each side support 106, 108 may interface with a respective mounting bracket 118 to facilitate mounting the rotational organizer 100 to the surface. For example, each side support 106, 108 may interface with a respective mounting bracket 118 via one or more tabs (e.g., a tab and slot construction), via a friction fit (e.g., "press-fit"), via a snap-fit, via one or more fasteners (not shown) such as rivets, screws, nuts and bolts, welding, plastic welding, or the like. An interface type of each side support 106, 108 with the mounting bracket 118 may be dependent on a material of components of the side supports 106, 108 and/or the mounting brackets 118, an intended application environment of the rotational organizer 100, a desired strength or load bearing capacity of the rotational organizer 100, or the like.

In some examples, the mounting brackets 118 are affixed to the surface (e.g., via fasteners, a tab and slot arrangement, or the like) and the rotational organizer 100 is removably interfaced with the mounting brackets 118. For example, a tab of a component of the rotational organizer 100, such as a support frame 200, may slide into a corresponding slot of a mounting bracket 118, and the rotational organizer 100 may be slid into a locking or retaining position of the mounting bracket 118. This may enable multiple possible mounting orientations for the rotational organizer 100, such as vertically from a ceiling or surface above the rotational organizer 100, horizontally from a surface next to the rotational organizer 100, from an angled surface, vertically from a surface beneath the rotational organizer 100, or the like. In other examples, the mounting brackets are affixed to the rotational organizer 100 and the combined rotational organizer 100 and mounting brackets 118 are then affixed to the surface.

Examples of individual components of the rotational organizer 100 will now be described below. Although certain examples of the components of the rotational organizer 100 are described and shown herein, the components of the rotational organizer 100 may be adapted to suit a particular intended application or application environment for the rotational organizer, such as by changing size, shape, material, formation process, or the like.

Figure 2:
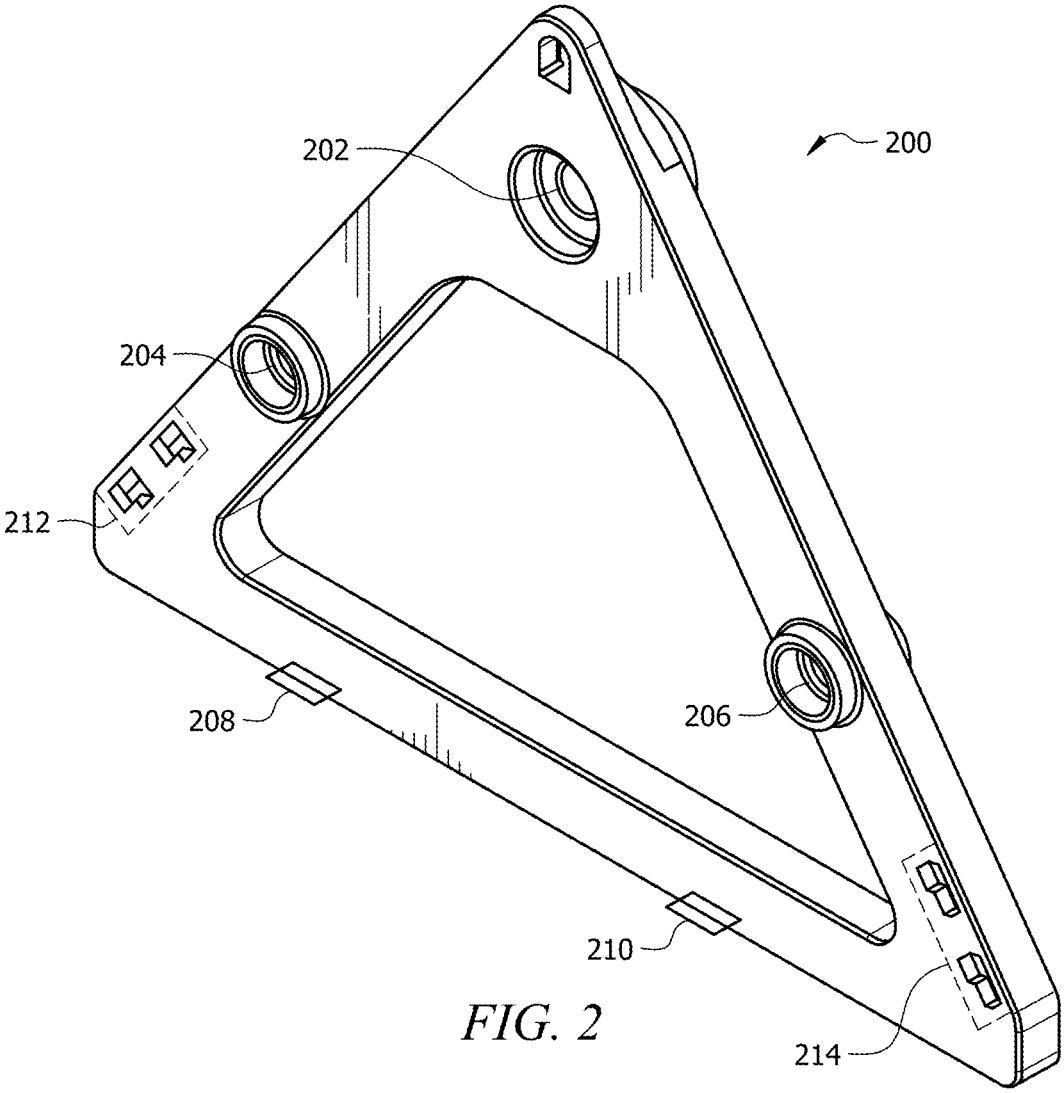
FIG. 2 is an illustration of a support frame, in accordance with various examples.

FIG. 2 is an illustration of a support frame 200, in accordance with various examples. In at least some examples, the support frame 200 is one implementation suitable for use as the support frames 102, 104. In an example, the support frame 200 is approximately symmetrical about a vertical axis (not shown) bisecting the support frame 200 into two approximately equal halves. In this way, the support frame 200 may be interchangeable for use as the support frame 102 (e.g., on a first end of the rotational organizer 100) or the support frame 104 (e.g., on a second end of the rotational organizer 100 that is opposite to the first end).

In an example, the support frame 200 includes an aperture 202, an aperture 204, and an aperture 206. As shown in FIG. 2, the support frame 200 has a substantially triangular shape with a center void. However, in other examples a shape of the support frame 200 may be modified to suit a particular use case or application environment. Similarly, the center void may reduce a weight of the support frame 200 and cost associated with production of the support frame 200. However, to suit a particular use case or application environment, the center void may be omitted such that the center of the support frame is substantially solid, or a patterned material is present (such as a honeycomb structure, a support structure, a structure comprising a grid of geometric shapes, or the like).

In some examples, the center axle 114 passes through the aperture 202 to interface the support frame 200. In some examples, the support frame 200 retains the center axle 114 in the aperture 202 via a snap-fit, a press-fit, or the like, as described above herein. In some examples, the apertures 204, 206 may be optional. For example, the apertures 204, 206 may be included to facilitate locking of the rotational organizer 100 to prevent uncontrolled rotation. For example, a spin actuated pin (not shown) may interface with one or both of the apertures 204, 206 to lock (e.g., limit or prevent) rotation of the end caps 110, 112 with respect to the side supports 106, 108.

In some examples, the support frame 200 includes mounting points 208, 210. The mounting points 208, 210 may support affixing the support frame to a surface, such as via fasteners, a tab and slot arrangement, adhesive, a peg mount, or the like. In other examples, the mounting points 208, 210 may be omitted or the mounting points 208, 210 may facilitate interfacing of the support frame 200 with a mounting bracket 118, as described above herein. In some examples, the support frame 200 may be substantially solid in construction. In other examples, the support frame 200 may be substantially hollow in construction. In yet other examples, the support frame 200 may include one or more support structures (not shown) retained within outer walls of the support frame 200, such as a honeycomb structure or the like. Although not shown in FIG. 2, in some examples, the support frame 200 may include one or more structural reinforcements of any suitable material and design, such as to provide increased strength, rigidity, or otherwise render the support frame 200 more suitable for use in a rotational organizer 100 in a particular application environment than otherwise in the absence of the structural reinforcements.

In an example, the support frame 200 includes first slots 212 and second slots 214. The support frame 200 may interface with a side support, such as the side supports 106, 108, via the first slots 212 and second slots 214 to form a structure of the rotational organizer 100. For example, the side support 106 may interface with the first slots 212 and the side support 108 may interface with the second slots 214 to form the structure of the rotational organizer 100. In some examples, clips (not shown) or other retaining mechanisms may lock the side supports 106, 108 into the first slots 212 and second slots 214, respectively.

Figure 3A:
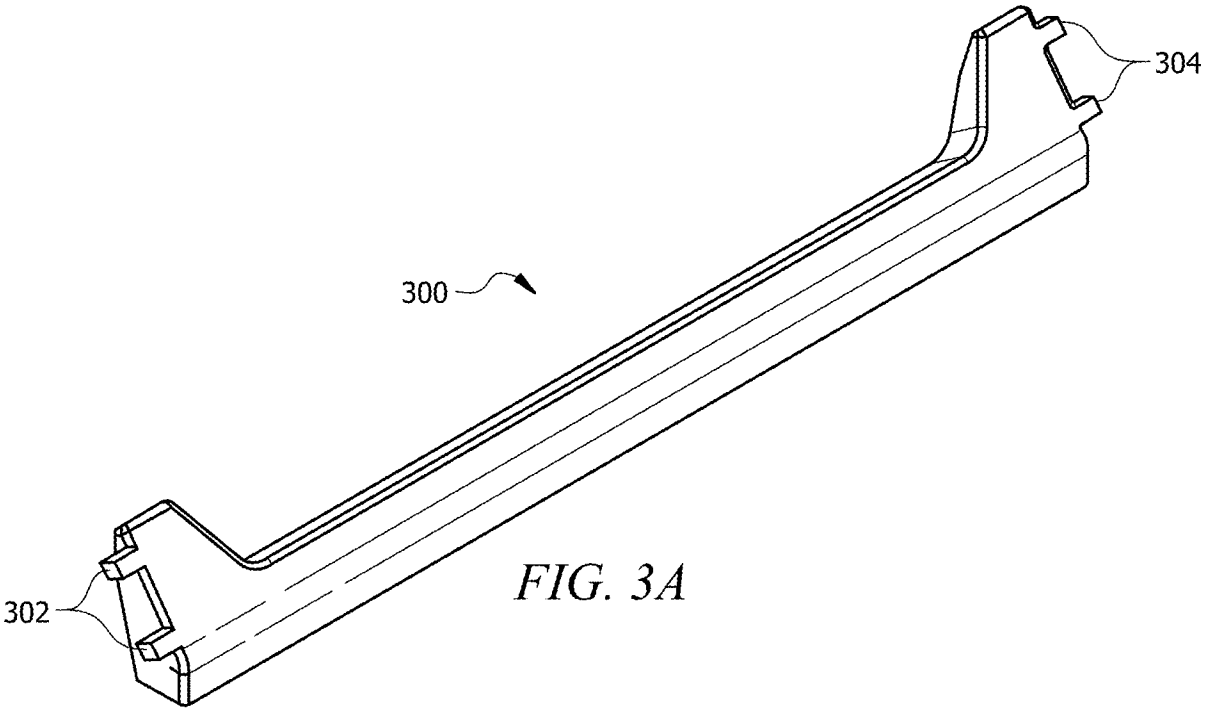
FIGS. 3A and 3B are illustrations of a side support, in accordance with various examples.
Figure 3B:
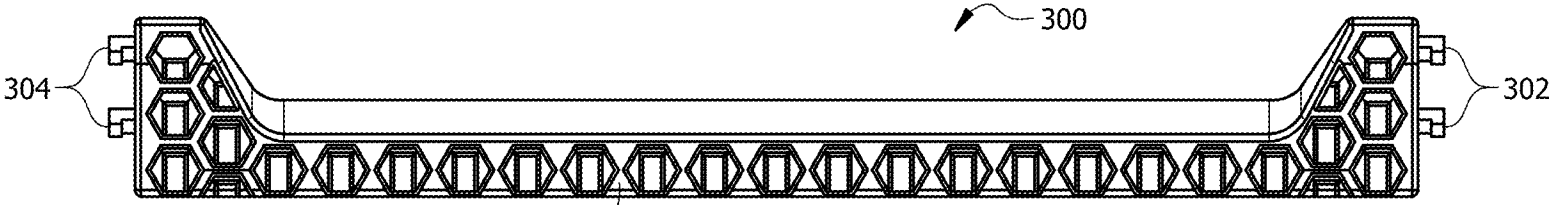

FIGS. 3A and 3B are illustrations of a side support 300, in accordance with various examples. In at least some examples, the side support 300 is one implementation suitable for use as the side supports 106, 108. In an example, the side support 300 is approximately symmetrical about a vertical axis (not shown) bisecting the side support 300 into two approximately equal halves. In this way, the side support 300 may be interchangeable for use as the side support 106 (e.g., on a first side of the rotational organizer 100 and perpendicular to the first and second ends of the rotational organizer 100) or the side support 108 (e.g., on a second side of the rotational organizer 100 that is opposite to the first side and perpendicular to the first and second ends of the rotational organizer 100).

In an example, the side support 300 includes tabs 302, tabs 304, and structural reinforcement 306. While shown in FIG. 2 as having a particular shape, in other examples a shape of the side support 300 may be modified to suit a particular use case or application environment.

In some examples, the side support 300 interfaces with a first support frame, such as a support frame 200, via the tabs 302. Similarly, the side support 300 may interface with a second support frame, such as a second support frame 200, via the tabs 304. In this way, the side support 300 spans the first and second support frames, to provide a combined structure with increased rigidity. In various examples, a size of the side support 300, including at least a length of the side support 300, may be adaptable in manufacture of the side support 300, such as to provide for a rotational organizer 100 of varying lengths.

The structural reinforcement 306 may be provided in an interior of the side support 300, at least partially shielded from view by an outer surface of the side support 300. In some examples, the structural reinforcement 306 provides for increased strength and rigidity of the side support 300. However, in some examples, the structural reinforcement 306 may be omitted, such as to reduce cost or weight associated with the side support 300. As shown in FIG. 3B, the structural reinforcement 306 comprises a grid of material having a repeating generally hexagonal shape. However, in other examples other geometric, or irregular, patterns or shapes may be suitable.

Figure 4A:
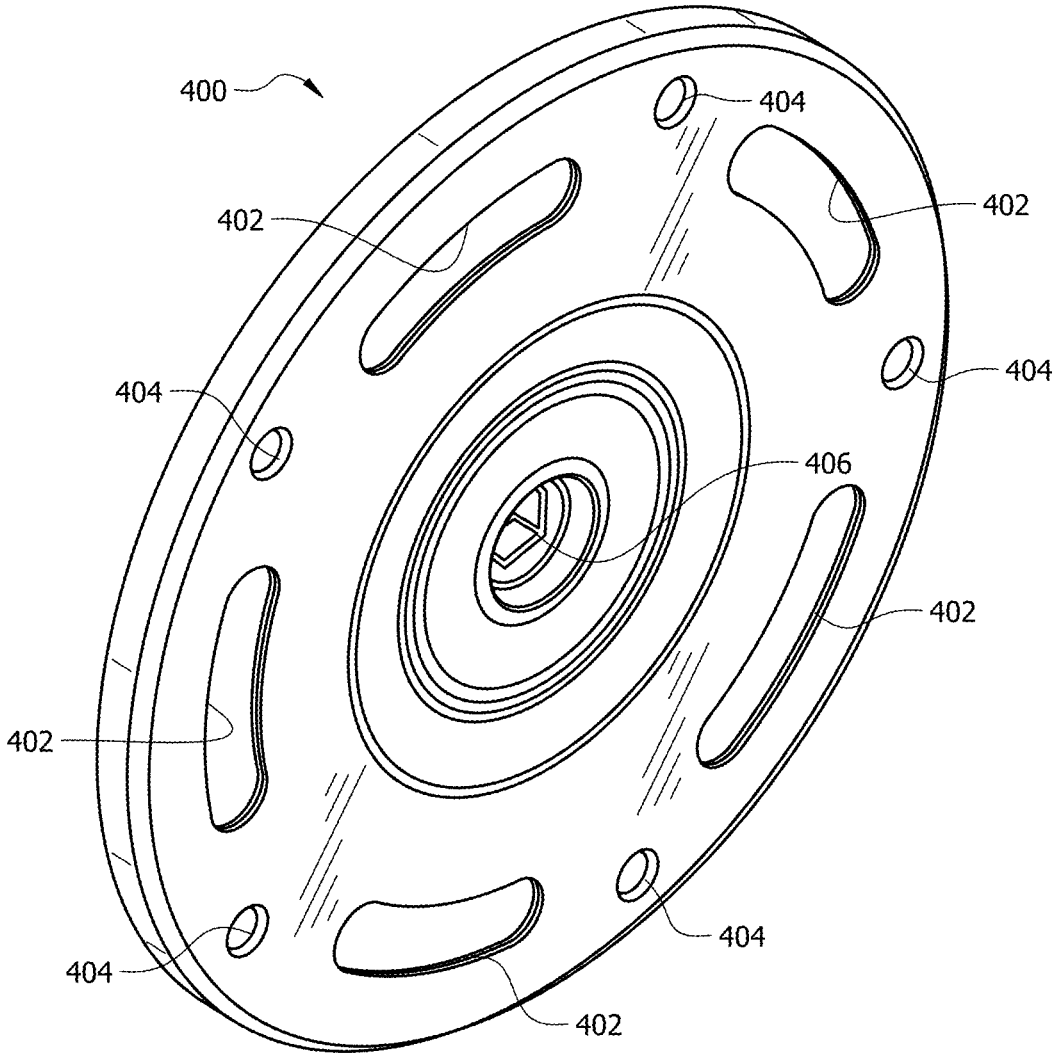
FIGS. 4A and 4B are illustrations of an end cap, in accordance with various examples.
Figure 4B:
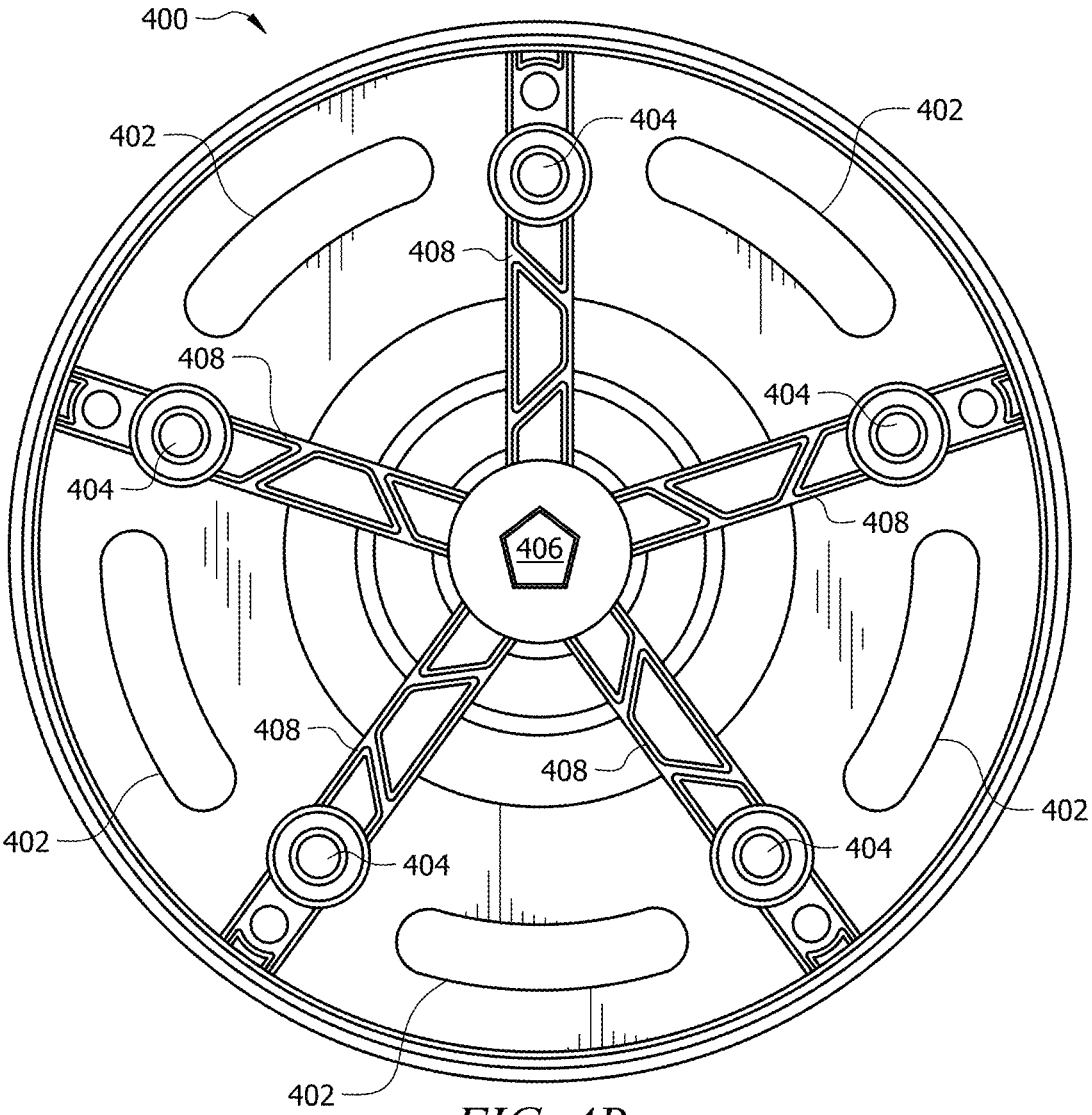

FIGS. 4A and 4B are illustrations of an end cap 400, in accordance with various examples. In at least some examples, the end cap 400 is one implementation suitable for use as the end caps 110, 112. In an example, the end cap 400 is approximately symmetrical about a vertical axis (not shown) bisecting the end cap 400 into two approximately equal halves. In this way, the end cap 400 may be interchangeable for use as the end cap 110 (e.g., on the first end of the rotational organizer 100) or the end cap 112 (e.g., on the second end of the rotational organizer 100). In an example, the end cap 400 includes apertures 402, apertures 404, an aperture 406, and structural reinforcement 408. As shown in FIGS. 4A and 4B, the end cap 400 has a substantially circular shape. However, in other examples a shape of the end cap 400 may be modified to suit a particular use case or application environment.

In some examples, the apertures 402 may be contact points to facilitate rotation of the rotational organizer 100. For example, a user may grip the end cap 400 with one or more fingers passing through an aperture 402 and exert force on the end cap 400 to cause the end cap 400 to rotate about its center point. In other examples, the apertures 402 may be omitted such that a user may grasp an edge of the end cap 400 and exert force on the end cap 400 to cause the end cap 400 to rotate about its center point. A slat 116 may interface with the end cap 400 at a respective aperture 404 to affix the slat 116 to the end cap 400 at that respective aperture 404, such as described above herein. In some examples, the slat 116 interfaces with the aperture 404 via a snap fit to enable the aperture 404 to retain the slat 116 while also enabling the slat 116 to rotate with respect to the end cap 400.

In some examples, the center axle 114 passes through, or interfaces with, the aperture 406. For example, the aperture 406 may be larger in diameter than at least a portion of the center axle 114 to enable the center axle 114 to pass through the aperture 406. In some examples, the end cap 400 spins freely around the center axle 114. In other examples, a shape of at least a portion of the center axle 114 corresponds to a shape of the aperture 406. For example, the shape may be a triangle, a square, a pentagon, a hexagon, or any other suitable shape. The center axle 114 may interface with the end cap 400 such that the end cap 400 and the center axle 114 rotate in unison.

In some examples, the end cap 400 may be substantially solid in construction. In other examples, the end cap 400 may be substantially hollow in construction. In yet other examples, the end cap 400 may include one or more support structures (not shown) retained within outer walls of the end cap 400, such as a honeycomb structure or the like. Although not shown in FIG. 4A or 4B, in some examples, the end cap 400 may include one or more structural reinforcements of any suitable material and design, such as to provide increased strength, rigidity, or otherwise render the end cap 400 more suitable for use in a rotational organizer 100 in a particular application environment than otherwise in the absence of the structural reinforcements.

In some examples, the structural reinforcement 408 may be provided on an outer surface of the end cap 400. In some examples, the structural reinforcement 408 provides for increased strength and rigidity of the end cap 400. However, in some examples, the structural reinforcement 408 may be omitted, such as to reduce cost or weight associated with the end cap 400.

In an example, the apertures 404 may pass fully through the end cap 400. As such, a pin, peg, or other locking mechanism may pass through an aperture 204, 206 of the support frame 200 to an aperture 404 of the end cap 400 to prevent rotation of the end cap 400 with respect to the support frame 200. In this way, the rotational organizer may be locked or otherwise prevented from rotating.

Figure 5A:
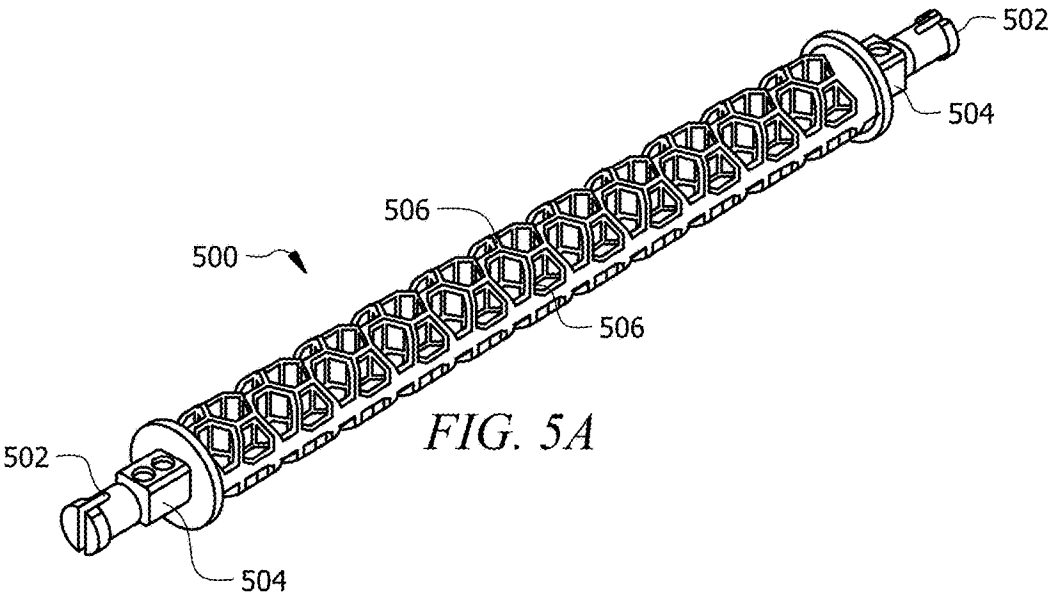
FIGS. 5A, 5B, and 5C are illustrations of a center axle, in accordance with various examples.
Figure 5B:
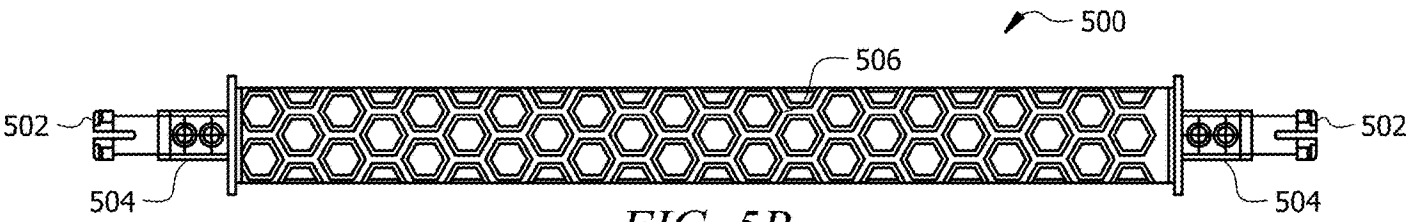
Figure 5C:
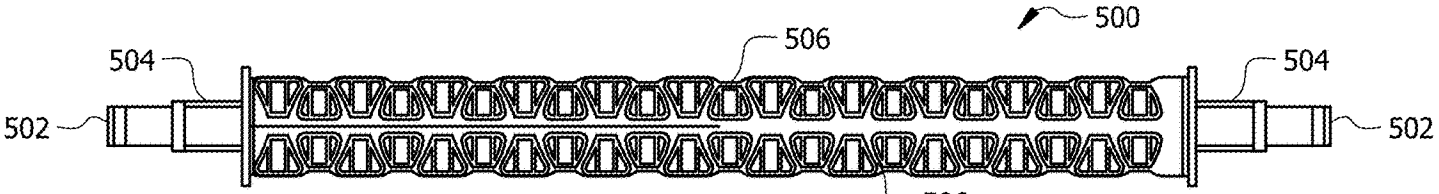

FIGS. 5A, 5B, and 5C are illustrations of a center axle 500, in accordance with various examples. In at least some examples, the center axle 500 is one implementation suitable for use as the center axle 114. In an example, the center axle 500 is approximately symmetrical about a vertical axis (not shown) or a horizontal axis (not shown) bisecting the center axle 500 into two approximately equal halves. In this way, the center axle 500 may be reversable. In an example, the center axle 500 includes connectors 502, drive portions 504, and structural reinforcement 506.

In an example, the center axle 114 passes through end caps 400, as described above herein, to interface with support frames 200, also as described above herein. In some examples, a shape of the drive portions 504 corresponds to a shape of apertures (e.g., apertures 406) of the end caps 400 to enable the center axle 114 and the end caps 400 to rotate in unison. The connectors 502 interface with the support frames 200 as described above to cause the support frames 200 to retain the center axle 114, such as via the apertures 202 of the support frames 200.

In some examples, the center axle 500 may be substantially solid in construction. In other examples, the center axle 500 may be substantially hollow in construction. In yet other examples, the center axle 500 may include one or more support structures (not shown) retained within outer walls of the center axle 500, such as a honeycomb structure or the like of any suitable material and design, such as to provide increased strength, rigidity, or otherwise render the center axle 500 more suitable for use in a rotational organizer 100 in a particular application environment than otherwise in the absence of the structural reinforcements.

In some examples, the structural reinforcement 506 may be provided on an outer surface of the center axle 500. In some examples, the structural reinforcement 506 provides for increased strength and rigidity of the center axle 500. For example, the structural reinforcement 506 may decrease torsional deflection of the center axle 500 in comparison to a center axle 500 that lacks the structural reinforcement 506. As shown in FIGS. 5A, 5B, and 5C, the structural reinforcement 506 comprises a grid of material having a repeating generally hexagonal shape. However, in other examples other geometric, or irregular, patterns or shapes may be suitable. In other examples, the structural reinforcement 506 may be omitted, such as to reduce cost or weight associated with the center axle 500.

Figure 6A:
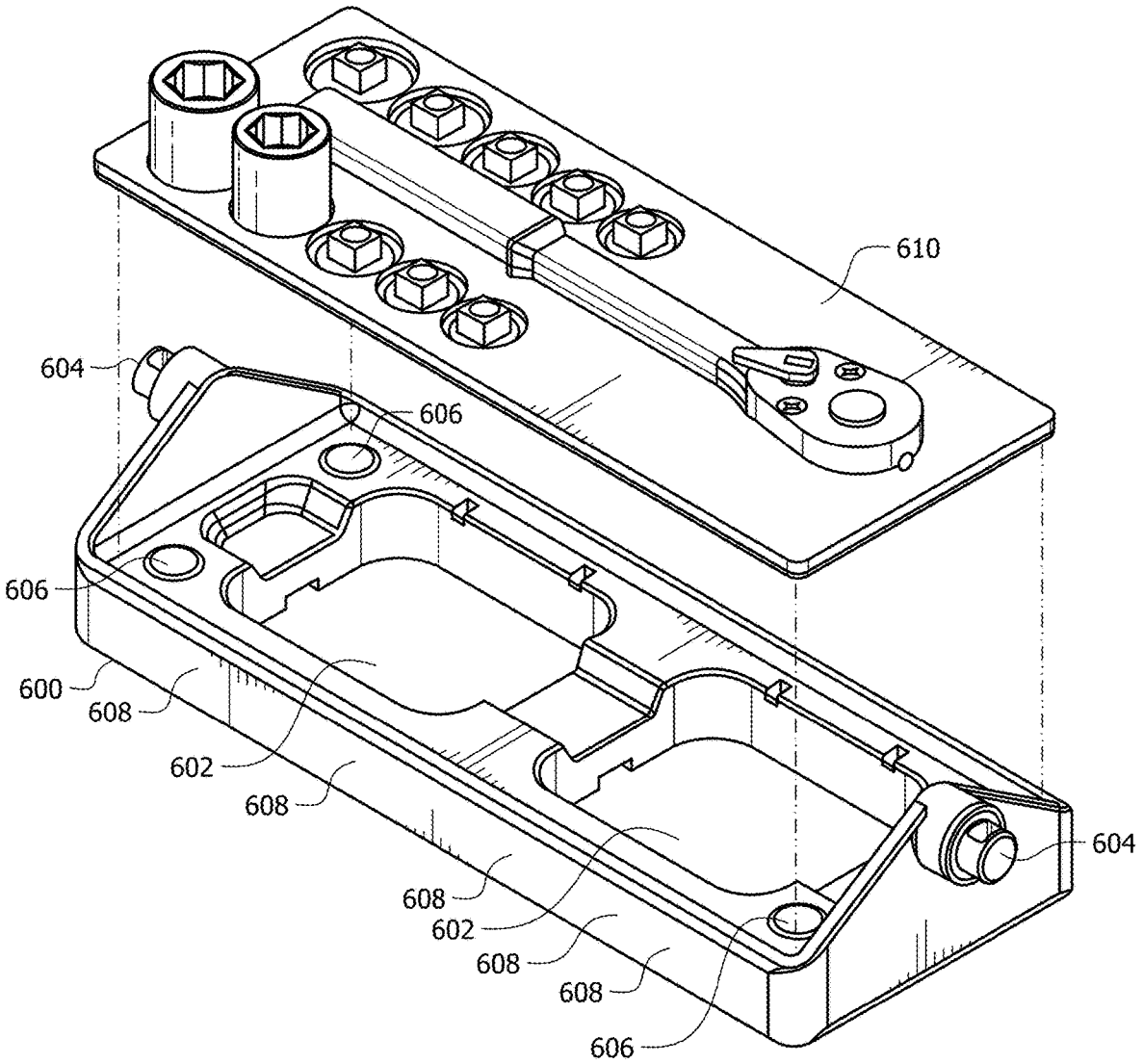
FIGS. 6A and 6B are illustrations of a slat, in accordance with various examples.
Figure 6B:
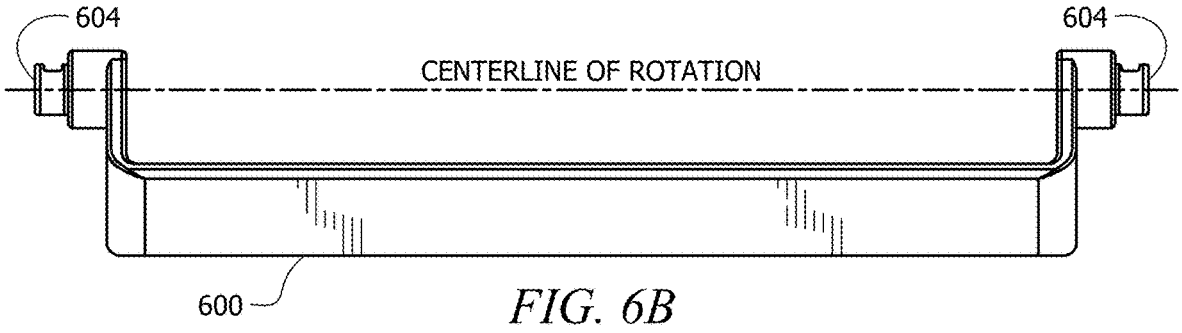

FIGS. 6A and 6B are illustrations of a slat 600, in accordance with various examples. In at least some examples, the slat 600 is one implementation suitable for use as one of the slats 116. In an example, the slat 600 is approximately symmetrical about a vertical axis (not shown) or a horizontal axis (not shown) bisecting the slat 600 into two approximately equal halves. In this way, the slat 600 may be reversable. In an example, the slat 600 includes apertures 602 and connectors 604. In some examples, the slat 600 also includes fasteners 606, such as magnets, and/or fasteners 608.

In some apertures 602 may be omitted, such that the slat 600 forms a tray having a substantially solid bottom. In other examples, the apertures have any suitable size and shape for retaining a container (not shown). In an example, the connectors 604 interface with the end cap 400, such as at apertures 404, as described above herein to cause the slat 600 to be retained between a pair of end caps 400. For example, a slat 600 may interface at a first connector 604 with a first end cap 400 and at a second connector 604 with a second end cap 400, such as described above herein. In this way, the slat 600 spans the first and second end caps 400. In some examples, the slat 600 interfaces with respective apertures 404 of the end caps 400 via a snap fit to enable the apertures 404 to retain the slat 600 while also enabling the slat 600 to rotate with respect to the end caps 400.

In some examples, the slat 600 may be substantially solid in construction. In other examples, the slat 600 may be substantially hollow in construction. In yet other examples, the slat 600 may include one or more support structures (not shown) retained within outer walls of the slat 600, such as a honeycomb structure or the like of any suitable material and design, such as to provide increased strength, rigidity, or otherwise render the slat 600 more suitable for use in a rotational organizer 100 in a particular application environment than otherwise in the absence of the structural reinforcements.

In an example, the slat 600 may interface with a slat tray 610. For example, the slat tray may have cutouts, indentions, or other contours suitable for retaining a particular item or items. For example, as shown in FIG. 6A, the slat tray 610 includes contours suitable for retaining a socket wrench and sockets. In an example, the slat tray may be sized to sit within the slat 600. The slat tray 610 may couple to the slat 600 via the fasteners 606 to retain the slat tray 610 on or within the slat 600. In some examples, the fasteners 608 may enable mounting of the slat 600 for storage. For example, the fasteners 608 may be tabs that enable storage of the slat 600 by sliding the tabs into corresponding slots in a tab and slot arrangement.

Figure 7:
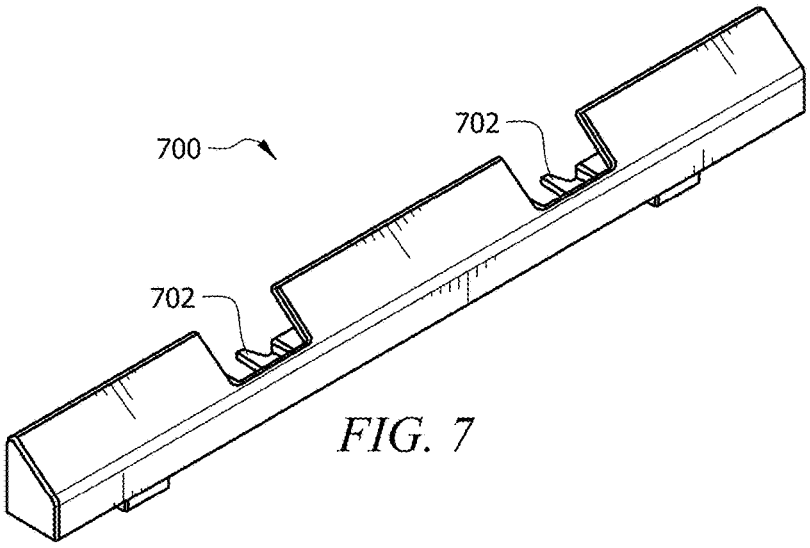
FIG. 7 is an illustration of a mounting bracket, in accordance with various examples.

FIG. 7 is an illustration of a mounting bracket 700, in accordance with various examples. In at least some examples, the mounting bracket 700 is one implementation suitable for use as one of the mounting brackets 118. In an example, the mounting bracket 700 is approximately symmetrical about a vertical axis (not shown) bisecting the mounting bracket 700 into two approximately equal halves. In this way, the mounting bracket 700 may be reversable. In an example, the mounting bracket 700 includes mounting points 702. In various examples, the mounting points 702 may takes various forms, such as anchoring points for use in conjunction with a fastener, tabs or hooks for use in a tab and slot arrangement, or the like.

In some examples, the mounting bracket 700 may be substantially solid in construction. In other examples, the mounting bracket 700 may be substantially hollow in construction. In yet other examples, the mounting bracket 700 may include one or more support structures (not shown) retained within outer walls of the mounting bracket 700, such as a honeycomb structure or the like of any suitable material and design, such as to provide increased strength, rigidity, or otherwise render the mounting bracket 700 more suitable for use in a rotational organizer 100 in a particular application environment than otherwise in the absence of the structural reinforcements. In some examples, the mountain bracket 700 may include components (not shown) capable of actuation to release the rotational organizer 100 from a mounting surface to which the rotational organizer 100 is mounted via one or more mounting brackets 700. For example, the component(s) may include a lever actuated, spring loaded wedge which locks the rotational organizer in place with respect to the mounting bracket 700 until such time as the lever is actuated. Responsive to actuation of the lever, the spring loaded wedge may release (such as by compressing the spring via actuation of the lever) to release the rotational organizer 100 from the mounting bracket 700.

Figure 8A:
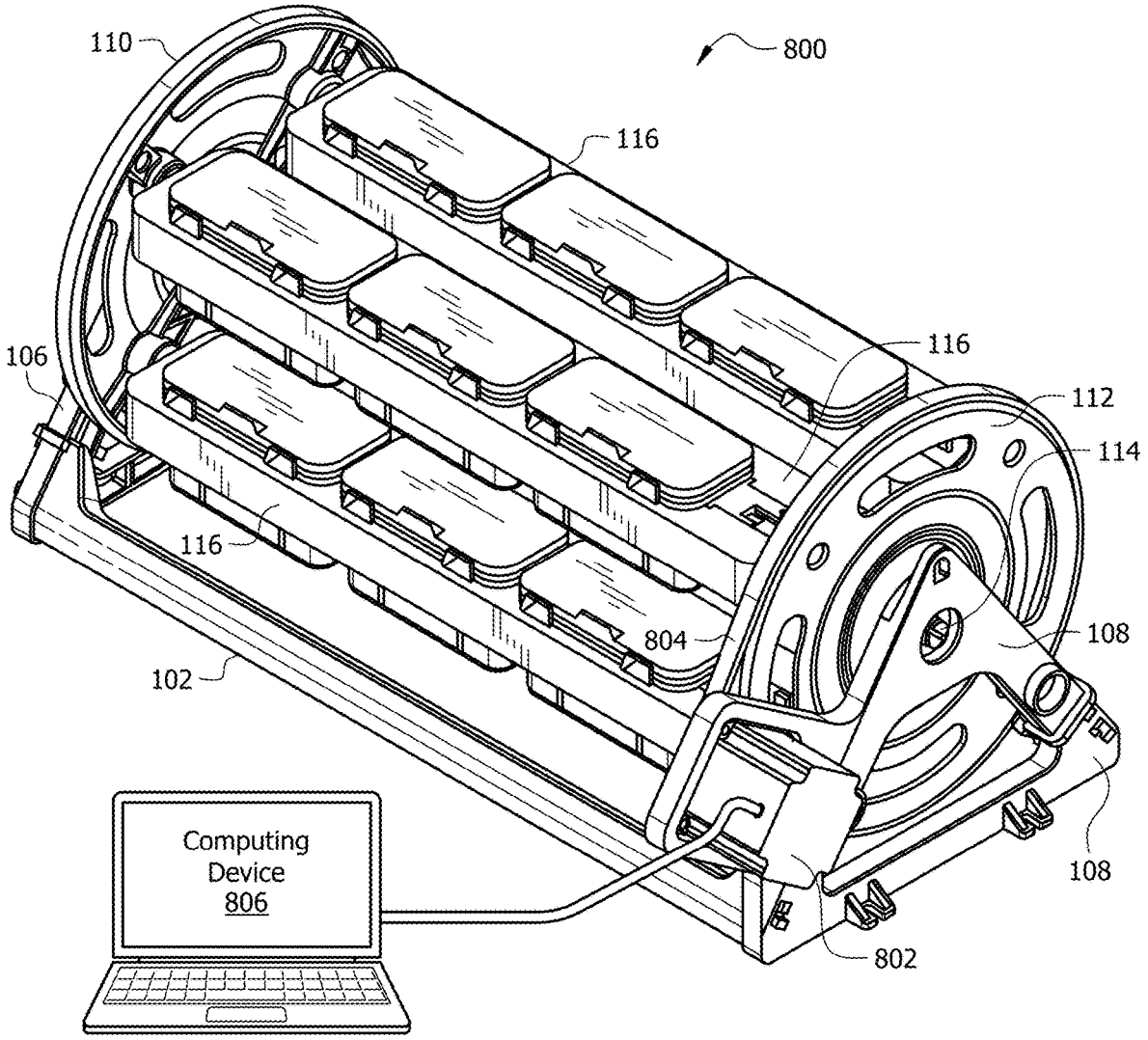
FIGS. 8A and 8B are illustrations of a motorized rotational organizer, in accordance with various examples.
Figure 8B:
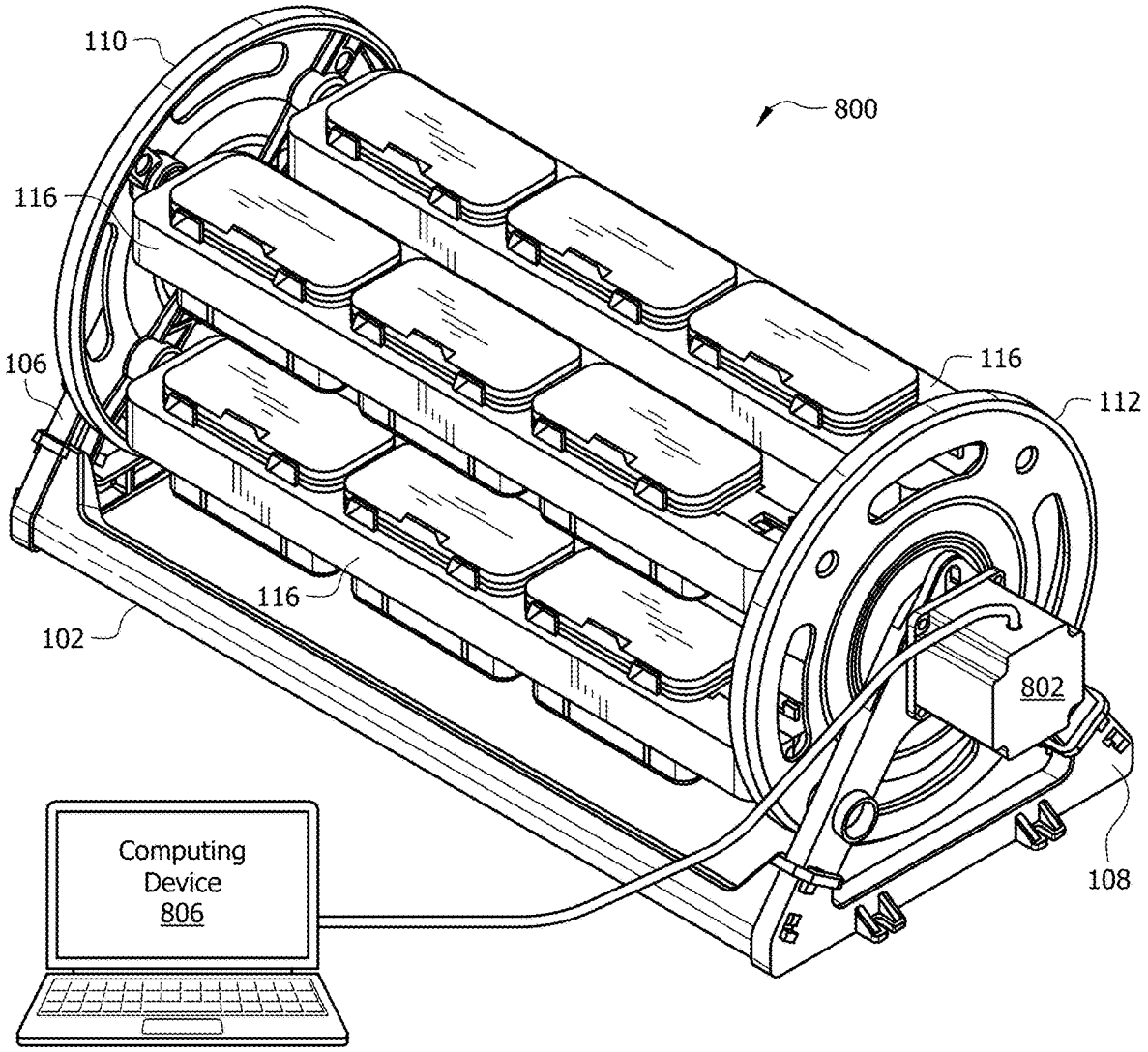

FIGS. 8A and 8B are illustrations of a motorized rotational organizer 800, in accordance with various examples. The rotational organizer 800 may include components of the rotational organizer 100, as described above herein, and a motor 802. The motor 802 may be any suitable type of motor, such as a stepper motor, a brushless motor, a brushed motor, a servo motor, or the like.

As shown in FIG. 8A, the motor 802 may be an indirect drive motor. For example, the motor 802 may interface with a drive belt 804 to drive the drive belt 804. The drive belt 804 may in turn interface with the end cap 112 to cause the end cap 112 to rotate, rotating the slats 116 of the rotational organizer 100. While shown as interfacing with the end cap 112, in some examples, the motor 802 and drive belt 804 may instead interface with the end cap 110. As shown in FIG. 8A, in some examples, the motor 802 may be mounted to the support frame 104. However, in other examples, the motor 802 may be mounted to the support frame 102, a side support 106, 108, or any other suitable component. The motor 802 may mount or couple to the rotational organizer 100 via a motor mount (not shown) that interfaces with a component of the rotational organizer 100, or may mount in a component of the rotational organizer 100 which is adapted, constructed, or otherwise formed to accommodate mounting of the motor 802. For example, resulting from the modularity of the rotational organizer 100, the support frame 104 may have various interchangeable implementations, at least one of which include a suitable structure for mounting the motor 802 to the support frame 102. The drive belt 804 may be a flat belt, a v-belt, a cogged belt, or have any other suitable shape or form for driving the end cap 112 based on motion of the motor 802.

As shown in FIG. 8B, the motor 802 may alternatively be a direct drive motor. For example, the motor 802 may interface with the central axle 114 to rotate the central axle 114, rotating the slats 116 of the rotational organizer 100 about the center axle 114. As shown in FIG. 8B, in some examples, the motor 802 may be mounted to the support frame 104. The motor 802 may mount to the support frame 104 via any suitable attachment type, with or without the use of fasteners.

Referring to both FIGS. 8A and 8B, in some examples, the motor 802, and therefore rotational organizer 100, may be automated. For example, a computing device 806 may communicatively couple to the motor 802 via wired (as shown in FIGS. 8A and 8B) or wireless communication (not shown). The computing device 806 may provide control signals to the motor 802 to motion of the motor 802 and resulting rotation of the rotational organizer 100. For example, the computing device 806 may be programmed with information relating to the slats 116, contents of particular slats 116, or the like. In this way, the computing device 806 may control the motor 802 to rotate the rotational organizer 100 to cause a particular slat 116, such as a particular slat 116 containing a desired or sought content, to rotate into a particular position, such as to enable access to the slat 116 by a user. In some examples, the computing device 806 may also receive or read information from the motor 802, or a sensor (not shown) to provide the computing device 806 with current position information of the motor 802 and/or rotational organizer 100.

Although not shown, in some examples, the computing device 806 may be a controller, microcontroller, or the like that is mounted to the rotational organizer 100. In other examples, the computing device 806 is a remote component that is coupled to the rotational organizer via wired or wireless communication. In some examples in which the computing device 806 is remote from the rotational organizer 100, the rotational organizer 100 may include a motor controller (not shown) mounted to the rotational organizer 100 to interface between the computing device 806 and the motor 802. In other examples, the motor 802 may include circuitry suitable for interfacing with the computing device 806 located remote to the rotational organizer 100.

In this description, unless otherwise stated, "about," "approximately" or "substantially" preceding a parameter means being within +/−10 percent of that parameter. Modifications are possible in the described examples, and other examples are possible within the scope of the claims.

What is claimed is:

1. A rotational organizer, comprising:

first and second support frames;

first and second side supports configured to couple to the first and second support frames via a tab and slot arrangement to span the first and second support frames;

first and second end caps; and an axle configured to pass through a center point of the first and second end caps to pivotally couple at a first end to the first support frame and at a second end to the second support frame, wherein the axle couples to the first and second end caps via a snap-fit, and wherein the axle comprises a lattice reinforcement structure.

2. The rotational organizer of claim 1, further comprising a slat having a first end and a second end, the first end of the slat configured to pivotally couple to the first end cap and the second end of the slat configured to pivotally couple to the second end cap, wherein the slat is parallel to the axle and can rotate around a horizontal axis of the axle.

3. The rotational organizer of claim 2, further comprising a second slat having a first end and a second end, the first end of the second slat configured to pivotally couple to the first end cap and the second end of the second slat configured to pivotally couple to the second end cap, wherein the second slat is parallel to the slat and the axle.

4. The rotational organizer of claim 2, wherein the slat has a drop neck structure causing a center of gravity of the slat to be lower than a rotational axis of the pivotal coupling.

5. The rotational organizer of claim 2, further comprising a tray configured to couple to the slat via a magnetic fastener.

6. The rotational organizer of claim 1, wherein the first and second end caps each include a reinforcement structure configured to increase rigidity of the first and second end caps.

7. The rotational organizer of claim 1, wherein the lattice reinforcement structure comprises a hexagonal shape.

8. The rotational organizer of claim 1, further comprising a mounting bracket, wherein the mounting bracket is configured to affix to a surface and removably couple to the first or second support frames to removably couple the rotational organizer to the surface.

9. The rotational organizer of claim 1, further comprising a locking mechanism configured to pass through apertures of one of the first or second support frames and a corresponding one of the first or second end caps to prevent rotation of the rotational organizer about the axle.

10. The rotational organizer of claim 1, wherein the rotational organizer couples together without the use of external fasteners.

11. A rotational organizer, comprising:

an axle;

a plurality of slats parallel to the axle, wherein each of the slats has a center of gravity located to cause bottom surfaces of each of the slats to be perpendicular to a gravitational force acting in a downward direction on the slats;

two end caps perpendicular to the axle, wherein the slats are retained between the end caps by pivotal couplings via which the slats and end caps can rotate around the axle; and two support frames, wherein the axle passes through the two end caps and the two support frames to pivotally couple to the two support frames, wherein the two end caps are retained by the two support frames, wherein the axle comprises a lattice reinforcement structure, wherein each coupling of the rotational organizer is a snap fit coupling.

12. The rotational organizer of claim 11, wherein the slats each have a drop neck structure to position the center of gravity of each respective slat lower than a rotational axis of each respective pivotal coupling of the slats to the two end caps.

13. The rotational organizer of claim 11, further comprising a tray configured to couple to the slats via a magnetic fastener.

14. The rotational organizer of claim 11, wherein the axle is formed of a non-metal material and a metal material.

15. The rotational organizer of claim 11, wherein the lattice reinforcement structure comprises a geometric shape in a repeating pattern.

16. The rotational organizer of claim 11, further comprising a motor coupled to the rotational organizer and a drive belt, wherein the motor is configured to drive one of the end caps via the drive belt to rotate the axle, end caps, and plurality of slats.

17. The rotational organizer of claim 11, further comprising a motor coupled to the axle and configured to drive the axle to rotate the axle, end caps, and plurality of slats.

18. The rotational organizer of claim 11, wherein the rotational organizer couples together without the use of external fasteners.

19. The rotational organizer of claim 11, wherein at least some components of the rotational organizer are hybrid material having a structure formed of at least a first material and a second material.

* * * * *